US005171077A

United States Patent [19]

Jondahl et al.

[11] Patent Number: 5,171,077

[45] Date of Patent: Dec. 15, 1992

[54] ROTATABLE FOOD SERVING HOUSING

[76] Inventors: Kenneth A. Jondahl, 3927 Oregon Ave. North; Brian L. Reed, 3933 Oregon Ave. North, both of New Hope, Minn. 55427

[21] Appl. No.: 698,826

[22] Filed: May 13, 1991

[51] Int. Cl.[5] ..... A47B 49/00

[52] U.S. Cl. ..... 312/249.3; 312/324

[58] Field of Search ..... 312/305, 324, 252; 211/129, 131

[56] References Cited

U.S. PATENT DOCUMENTS

D. 160,688 10/1950 Brock ..... 312/129 X 273,834 3/1883 Gardiner ..... 312/252

1,531,198 3/1925 Leckington ..... 312/252

4,126,366 11/1978 Handler et al. ..... 312/252

4,549,664 10/1985 Gowan et al. ..... 211/131

*Primary Examiner*—Joseph Falk

*Attorney, Agent, or Firm*—Hugh D. Jaeger

[57] ABSTRACT

A rotatable food serving housing including a rotating base assembly, a base including an umbrella accommodation sleeve and cold ice pack supports, at least two opposing food serving trays, and a cover including opposing hinged flaps for mating with the base, the umbrella accommodation sleeve and the cold ice pack supports.

16 Claims, 9 Drawing Sheets

ROTATABLE FOOD SERVING HOUSING

BACKGROUND OF THE INVENTION

1. Field of the Invention

The present invention pertains to a rotatable food serving housing, and more particularly, pertains to a food serving tray such as that used on a patio table with a patio umbrella, where the umbrella positions through the food serving tray. The food serving tray also holds cold ice packs, such as those known as Blue Ice, for cooling of the food serving trays.

2. Description of the Prior Art

Prior art food serving trays have generally not provided for refrigeration of the food product, especially over extended periods of time. This has provided for an unsanitary and unhealthy storage of food which may lead to primary and secondary health considerations.

The present invention overcomes the disadvantages of the prior art by providing a rotatable food serving housing with specific space for frozen, cold ice packs.

SUMMARY OF THE INVENTION invention is a rotatable food serving housing with hinged covers, removable food trays, and structure for supporting and retaining cold, frozen ice packs, such as those known as "Blue Ice". The food serving trays are removable from the rotatable food serving housing for ease in washing of the food serving trays. The trays engage within the housing and about the frozen, cold ice packs. The food serving housing can also accommodate a patio umbrella, such as for use on a patio table, where the food serving housing is in the center of the table and maintained in position by the umbrella and being inserted through the umbrella support in the rotatable food serving housing.

According to one embodiment of the present invention, there is provided a rotatable base assembly, a base structure affixed to the rotating base assembly including an umbrella support, frozen ice pack supports and food tray supports; two opposing food trays, which engage into the opposing food tray supports; and a corresponding like cover with hinged flaps for engaging about the ice pack supports and the umbrella supports with the base.

The table top revolving food tray or container is 18 inches in diameter. Two easy open/close hinged lids, one lid per side, keep dirt/insects away from the food inside, and also hold the cool air inside. Two frozen ice packs inside help prevent food spoilage and extend the time in which food can be enjoyed. The container has a large hole in the center that an umbrella pole can slide through (up to $1\frac{7}{8}''$ diameter pole) in order to save space on picnic tables. Separate food trays for easy clean up can be used inside or out. This invention implements especially well on picnic tables.

The revolving tray can be placed in the center of the picnic table with an umbrella pole through the center to save space on the table top. Two ice packs are positioned inside to help preserve freshness of food for longer periods of time. Two large food trays (each divided into 3 separate compartments) allow transportation of different foods to locations which saves trips back and forth. Lids open easily and stay open for easier access to food. Lids also close easily without having to latch covers onto containers. The revolving tray brings all food into easy reach of all persons sitting around most sized tables.

Significant aspects and features of the present invention include a rotatable food serving housing for maintaining food serving trays in position with respect to cold, frozen ice packs in the food serving housing.

Another significant aspect and feature of the present invention is a rotatable food serving housing which accommodates a patio umbrella and rotates about the patio umbrella, which extends through the food serving housing.

A further significant aspect and feature of the present invention is a food serving housing which retains cold, frozen ice packs in position with respect to the food trays and the food serving housing.

Further significant aspects and features include a hole through the center which accepts an umbrella pole up to $1\frac{7}{8}''$ diameter. Two ($6\frac{1}{2}''\times3\frac{3}{4}''\times1\frac{1}{2}''$ thick) ice packs are used to keep food cool and fresh. The revolving tray allows everyone at the table easy access to all food inside. Easy to open/close lids keeps dirt and insects away from the food.

Having thus described the embodiments of the present invention, it is the principal object hereof to provide a food serving housing with removable trays, cold, frozen ice pack accommodating structures, and a patio umbrella accommodating structure for centering the food serving housing about the center of a patio table when a patio table umbrella is in use.

One object of the present invention is a food serving housing which readily accommodates the cold, frozen ice packs.

Another object of the present invention are food serving trays which are easily removable for cleaning and exchanging of food.

Other objects of the present invention include hinged covers on each side of the tray which are easy to open and close, and maintain freshness of food and keep dirt and insects out. The rotating tray adds convenience to all parties setting around patio tables and eliminates reaching or passing of food. The rotating tray rotates around the umbrella pole to save table space.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
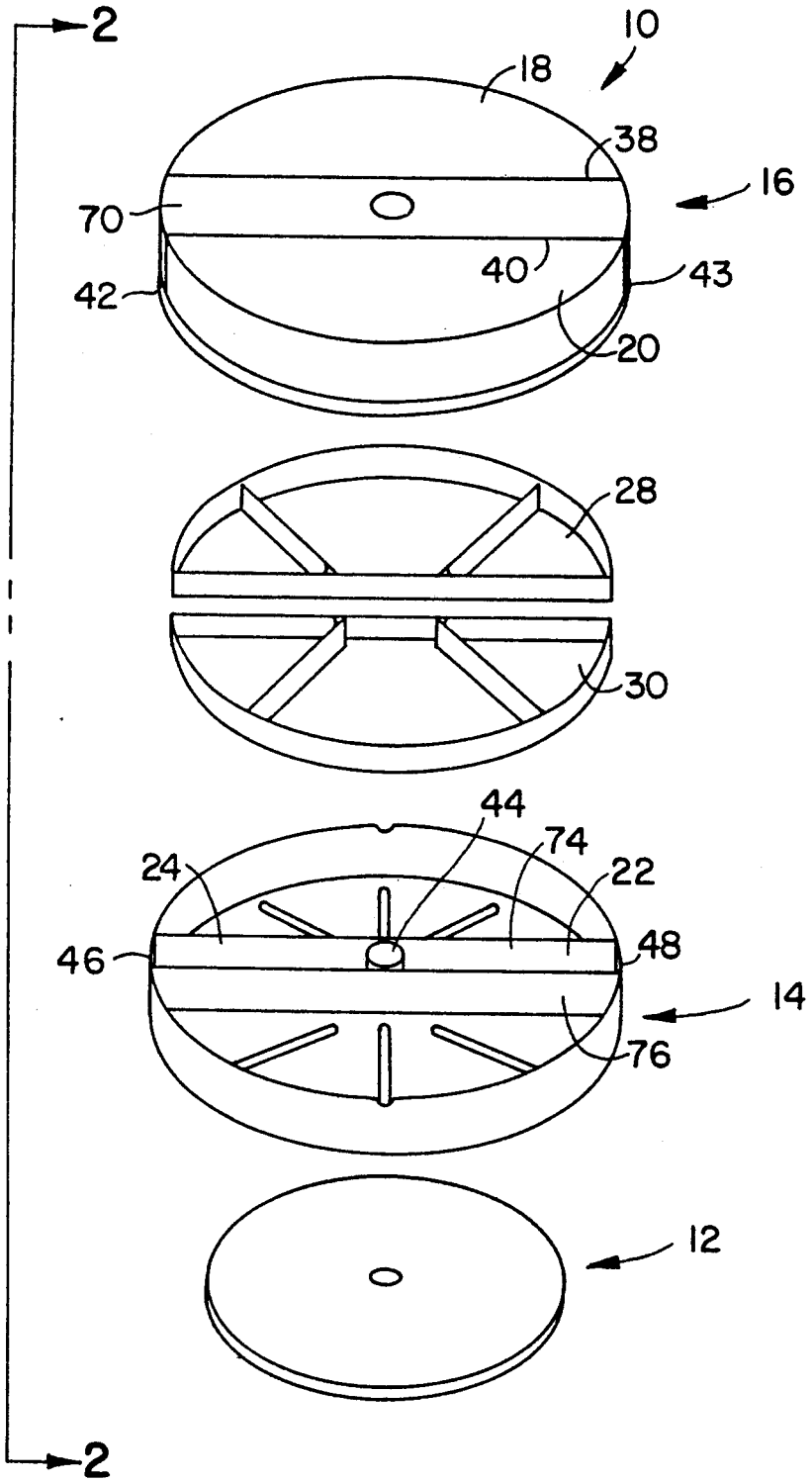
FIG. 1 illustrates an exploded view in perspective of the rotatable food serving housing, present invention.
Figure 4:
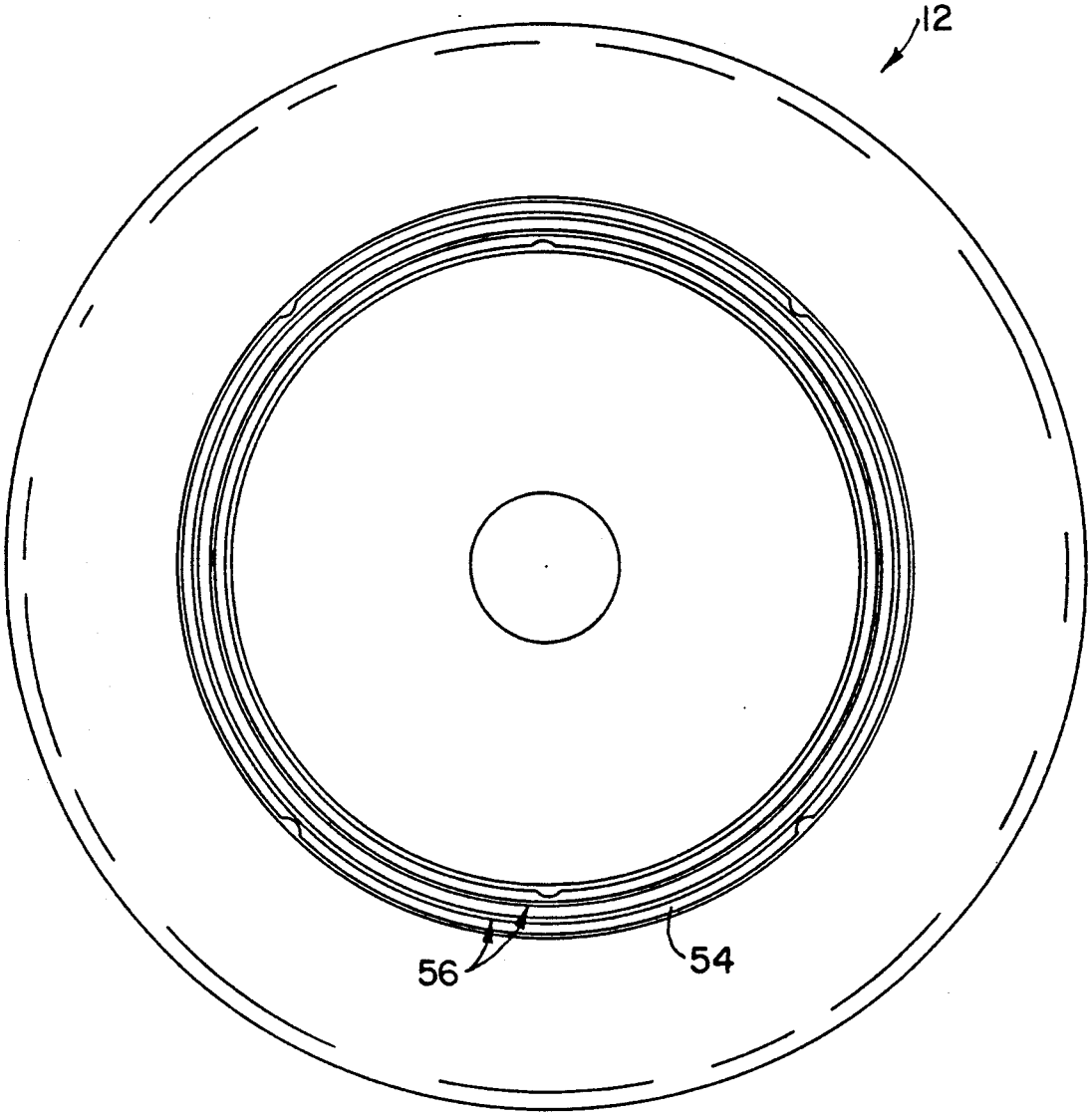
FIG. 4 illustrates a bottom view of the lower housing.
Figure 5:
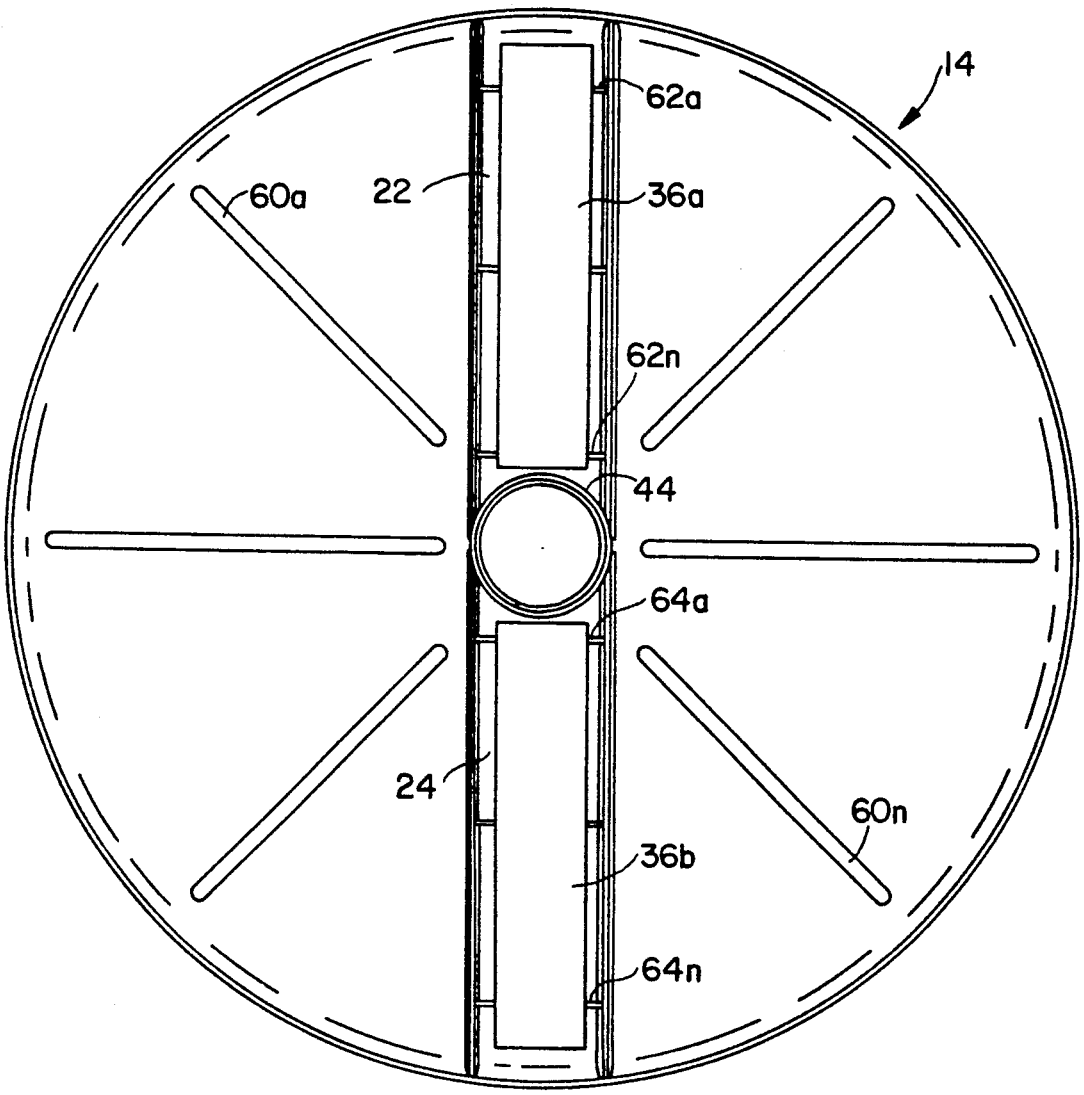
FIG. 5 illustrates a top view of the lower housing with the cover removed and food trays removed.

FIG. 1 illustrates an exploded view in perspective of a rotatable food serving housing 10, the present invention, including a swivel base 12, a lower housing 14, an upper housing 16 with hinged flaps 18 and 20. The flaps 18 and 20 pivot about the hinges 38 and 40. Suitable snap assemblies or other securing assemblies can be used to attach and align the ends of the upper housing 16 at points 42 and 43 to the opposing ends of the lower housing 14 at points 46 and 48 so that the rotatable food serving housing 10 is an integral unit with respect to food trays 28 and 30 disposed therein, the lower housing 14, and the upper housing 16. This alignment insures that the flaps 18 and 20 will align properly with the food trays 28 and 30 contained between the lower and upper housings 14 and 16, respectively. The swivel base 12 is that commonly available or used in other products, which includes a large circular ring 54, and a bearing ring 56 which rides on an inside track of a smaller ring and which rotates within the large circular ring 54 as illustrated in FIG. 4. The lower housing 14 includes two compartments 22 and 24 for retaining frozen, cold ice packs, commonly known as "Blue Ice" as illustrated in FIG. 5. Removable compartmentalized food trays 28 and 30 align in the lower housing 14. A cylindrical sleeve 44 for aligning about an umbrella pole 58 aligns through the center of the lower housing 14 between the compartments 22 and 24. The umbrella pole can be that type of an umbrella pole associated with a patio pole umbrella.

Figure 2:
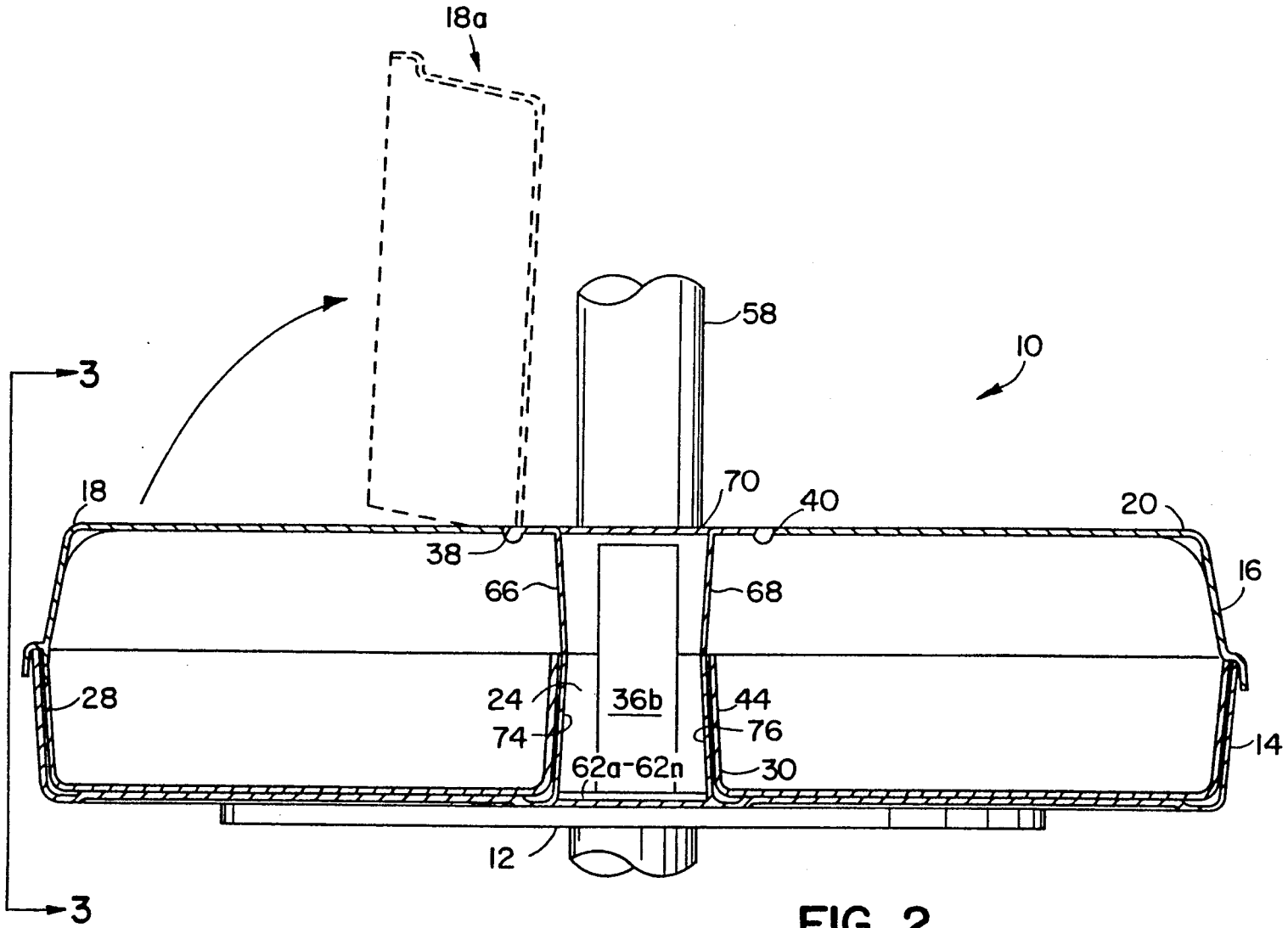
FIG. 2 illustrates a side view in partial cross section of the assembled rotatable food serving housing.
Figure 6:
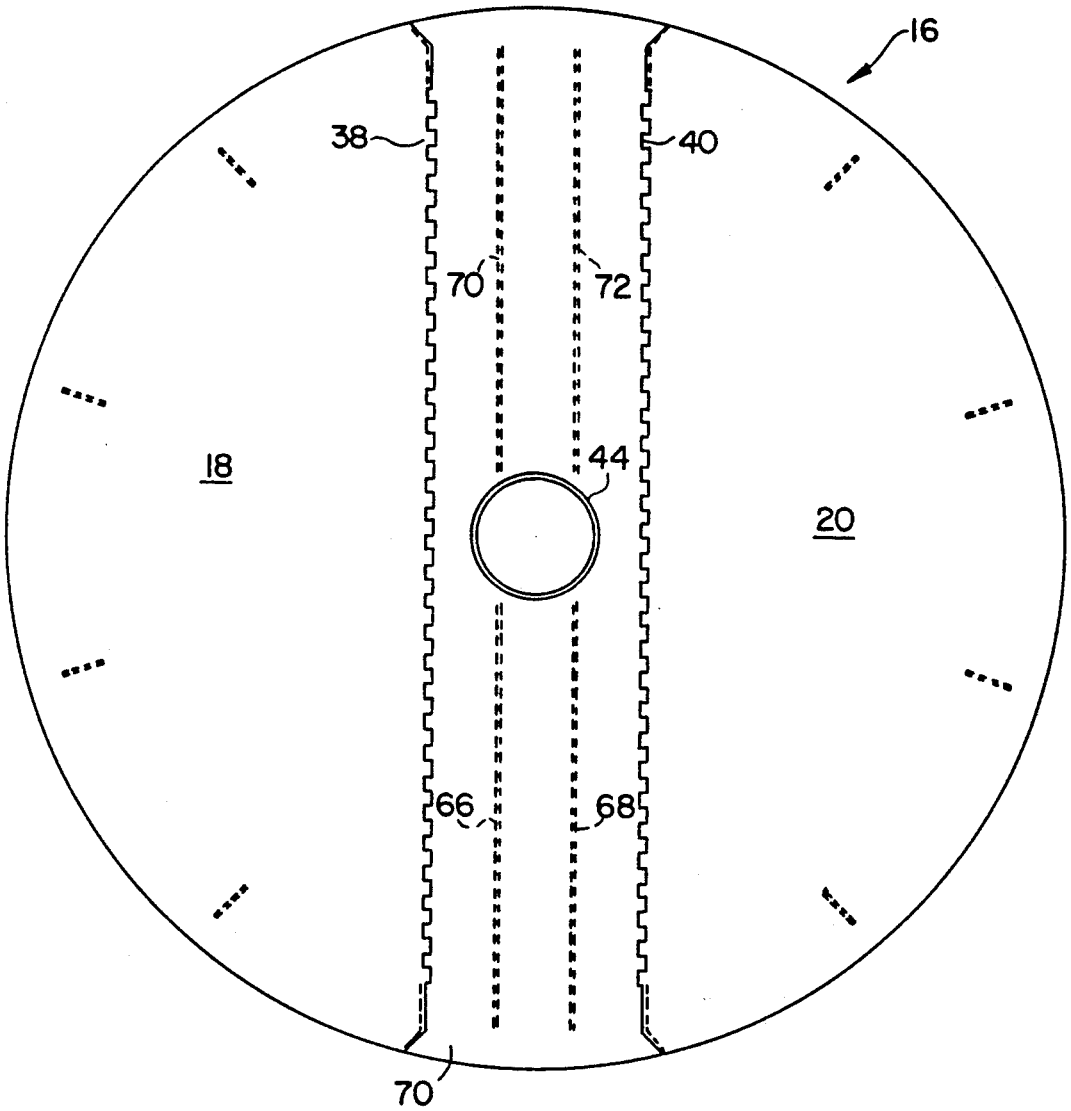
FIG. 6 illustrates a top view of the upper housing.

FIG. 2 illustrates a side view in partial cross section of the assembled rotatable food serving housing 10 along line 2—2 of FIG. 1 where all numerals correspond to those elements previously described. The hinged flap 18 can be rotated upwardly about the hinge 38 to position 18*a* as illustrated by dashed lines for gaining access to the compartmentalized food tray 28 which is illustrated residing in the lower housing 14. The hinged flap 20 operates in a like manner. An ice pack 36*b* is contained in compartment 24 and held in place at its top end by support members 66 and 68 extending downwardly from the central portion 70 of the upper housing 16. Like support members 70 and 72 extend downwardly from the central portion 70 of the upper housing 16 as illustrated in FIG. 6.

Figure 3:
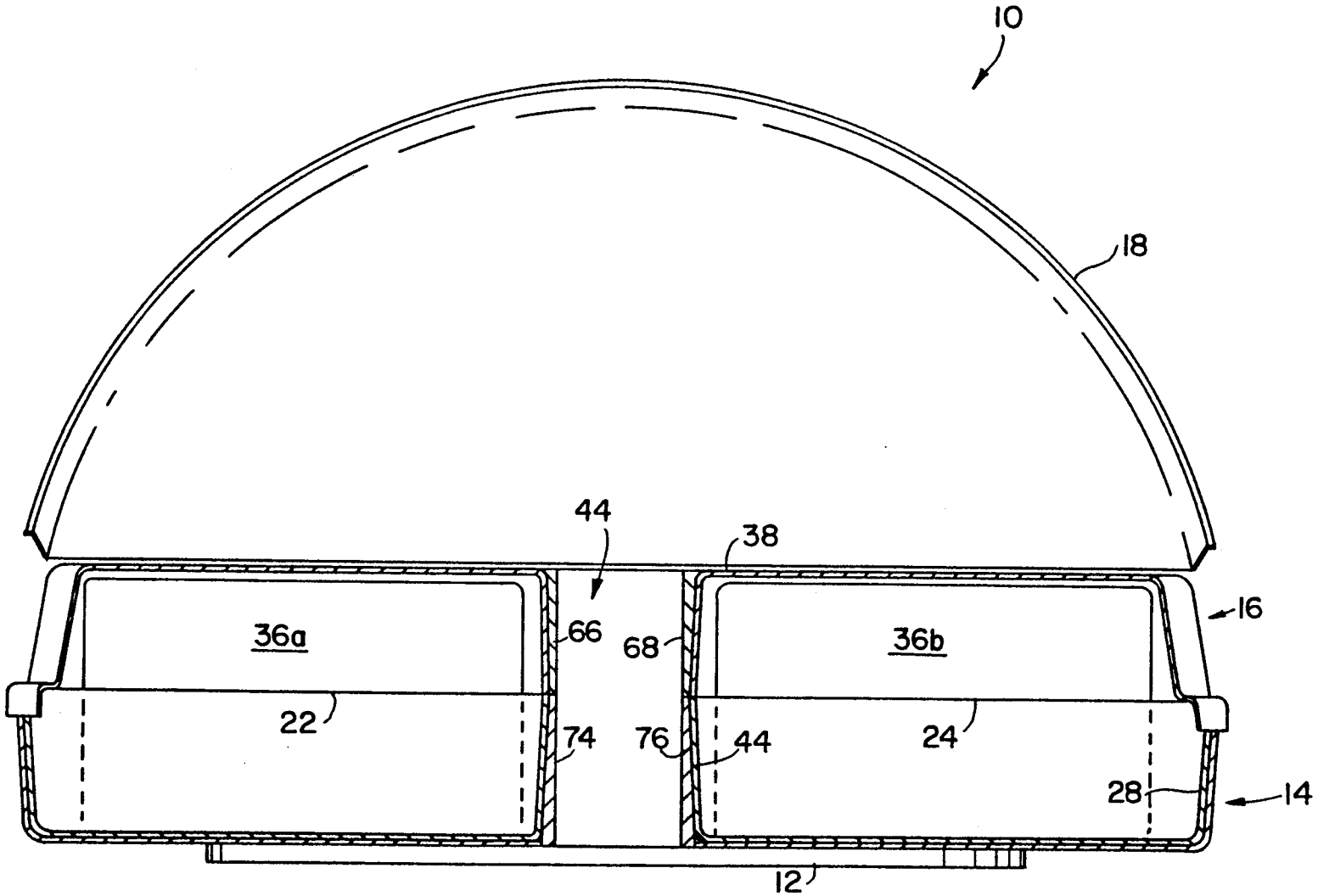
FIG. 3 illustrates a view in partial cross section of the rotatable food serving housing along line 3—3 of FIG. 2.

FIG. 3 illustrates a view along line 3—3 of FIG. 2 in partial cross section of the rotatable food serving housing 10 where all numerals correspond to those elements previously described. What is particularly illustrated is the placement of the ice packs 36*a* and 36*b* with respect to the food tray and the umbrella pole housing 44.

FIG. 4 illustrates a bottom view of the lower housing 14, particularly illustrating the swivel base 12 and the swivel assembly including the large circular member 54 and bearing ring 56.

FIG. 5 illustrates a top view of the lower housing 14 with the upper housing 16 and food trays 28 and 30 removed and particularly illustrates a plurality of dead air space inserts or rises 60*a*–60*n* to create a dead air space between the bottom of the food trays 28 and 30 and the base of the lower housing 14. This elevates the food trays 28 and 30 off the base of the bottom of the lower housing 14 and provides an insulative dead air space. A plurality of dead air space inserts or rises 62*a*–62*n* and 64*a*–64*n* align in the compartments 22 and 24, respectively, to create insulative dead air space beneath the ice packs 36*a*–36*b*.

FIG. 6 illustrates a top view of the upper housing 16 of a food serving housing 10, and particularly illustrates the hinges 38 and 40, as well as the placement of the ice pack support members 66–72 on the underside of the upper housing 16.

Figure 7:
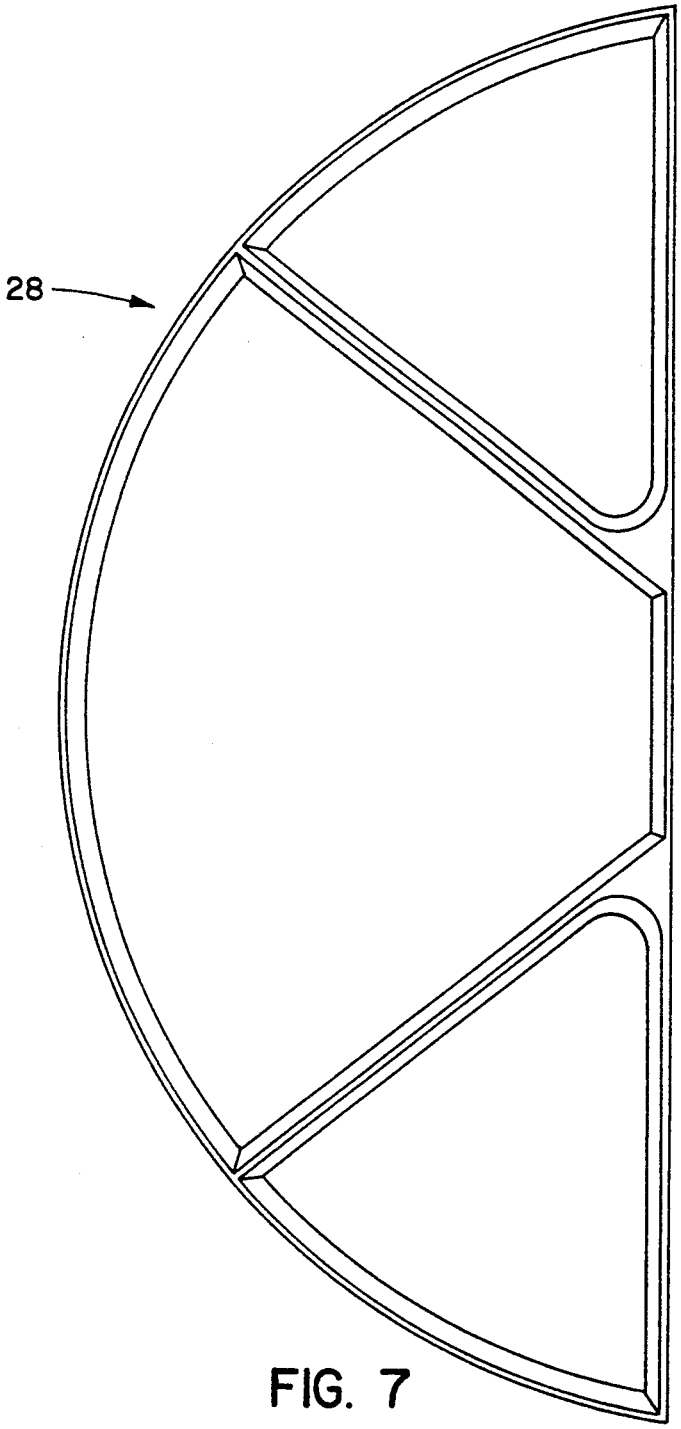
FIG. 7 illustrates a top view of a food tray.

FIG. 7 illustrates a top view of a food tray 28 particularly illustrating the three compartments. The three compartments are for purposes of illustration only and any desired number of compartments in different shapes may be used and shall not be construed to be limiting of the scope of the invention. The compartments can also be made to accommodate small beverage cans in lieu of food, or can be entirely removed to accommodate normal sized beverage cans. The outside dimensions of the food tray 28 are critical for placement within the lower housing 14 with respect to the rotatable food serving housing 10.

Figure 8:
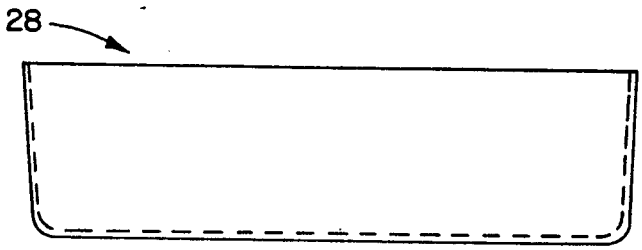
FIG. 8 illustrates an end view of the food tray.

FIG. 8 illustrates an end view of FIG. 7 where all numerals correspond to those elements previously described.

Figure 9:
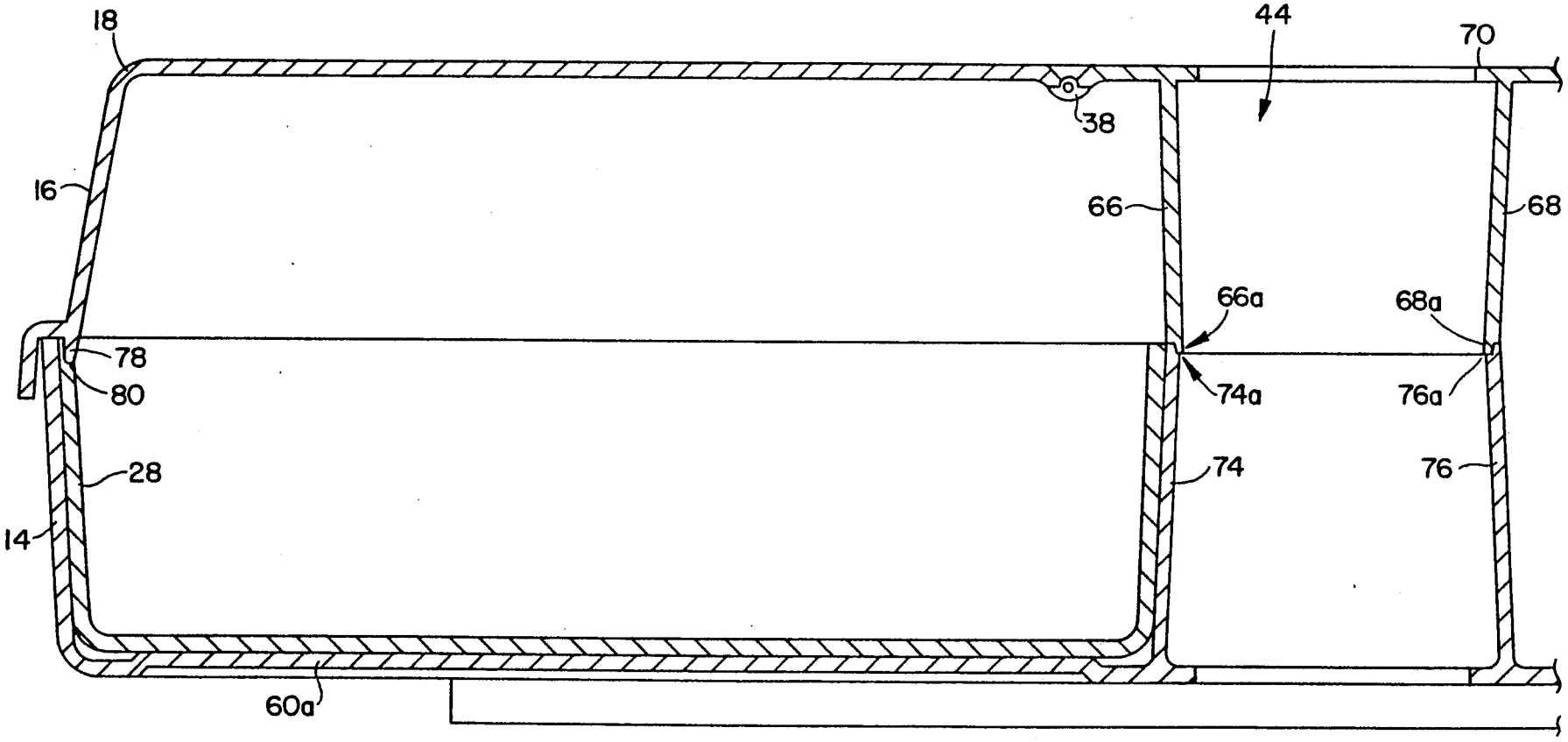
FIG. 9 illustrates a cross section of the hinged flap and the umbrella mast accommodation hole.

FIG. 9 illustrates a cross-sectional view of the hinged flap 18 and the umbrella mast accommodation hole 44. Vertically aligned supports 66 and 68 extend downwardly to mate with vertical support members 74 and 76 extending upwardly from the lower housing 14. Support extensions 66*a* and 68*a* mate with support extensions 74*a* and 76*a* to form lap joints. A tab 78 extends downwardly from hinged flap 18 and is accommodated by a recess 80 in the food tray 28 for integral stability of the unit. A like tab and recess in the hinged flap 20 align in a similar manner.

DESCRIPTION OF THE ALTERNATIVE EMBODIMENT

Figure 10:
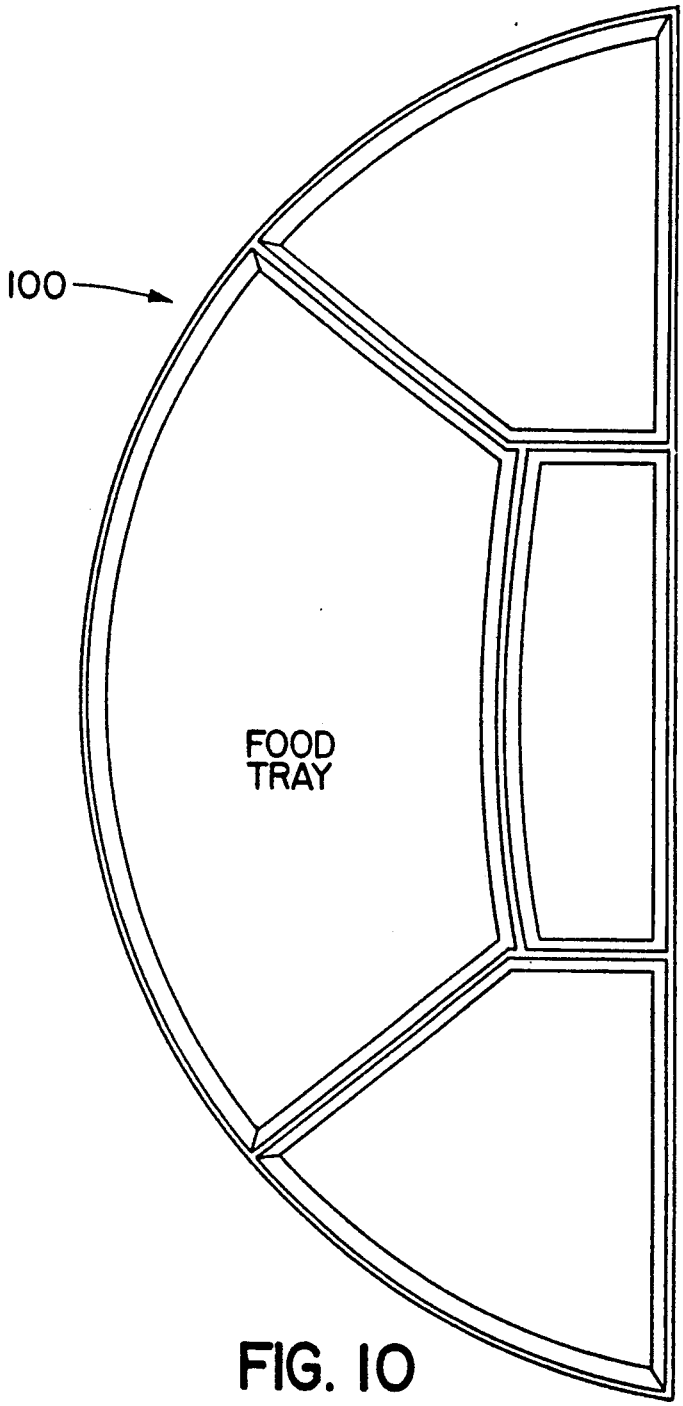
FIG. 10 illustrates a top view of an alternative embodiment of a food tray; and, FIG. 11 illustrates an end view of an alternative embodiment of a food tray.

FIG. 10 illustrates a top view of an alternative embodiment of a food tray 100 incorporating four compartments. All other dimensions of the food tray 100 are identical to those as illustrated in FIG. 7.

Figure 11:
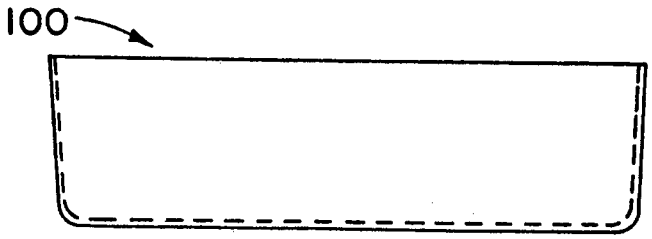

FIG. 11 illustrates an end view of FIG. 10.

MODE OF OPERATION

The 18" diameter rotating food serving housing 10 includes two easy to open hinged flaps 18 and 20 on the upper housing 16. The hinged flaps help keep cool air in, and insects, dirt and air currents out which cause the food to lose freshness quickly. There are two ice packs 36*a*–36*b* which fit inside the ice pack compartments 22 and 24 to keep food cool and fresh longer. Results of testing show that these ice packs will keep the food fresh and enjoyable for 3 to 3½ hours under adverse conditions, such as 90° F.@85% humidity. Obviously, the food will stay fresh longer under more ideal conditions.

There is a 2" diameter umbrella accommodation tube 44 running through the food serving housing 10 which allows the shaft from any purchased umbrella to pass through. The accommodation tube 44 fits closely about an umbrella mast to seal the interior of the rotatable food serving housing 10 from outside air and also to keep the cooled interior air within the confines of the housings. This saves a large amount of space on the top of a picnic table, which is normally wasted due to the shape of typical food containers and the fact that they must be placed around an umbrella shaft.

There are also two removable food trays 28 and 30 inside which can be filled on site or refilled in a residence, and brought outside in one trip making entertaining or relaxing outside easier. Since all the food is kept in these easily removable trays, clean up after using is readily accomplished. If one or both trays 28 or 30 are left out, there is also room for 6 beverage cans (12 oz.) on each side.

Various modifications can be made to the present invention without departing from the apparent scope hereof.

I claim:

1. Rotatable food serving housing comprising:

a. a base including opposing semicircular compartments generally forming a circle about a first central hole, with a space generally bisecting the circle on a diameter therebetween;

b. a swivel means on an underside of said base;

c. a semicircular food tray including a plurality of compartments for engaging into each of said semicircular compartments; and, d. a top including two opposing hinged covers engaging with said base and a second central hole extending therethrough for aligning with the first central hole.

2. The rotatable food serving housing of claim 1 including lower and upper shafts in said base and said top about said central holes for receiving an umbrella pole

3. The rotatable food serving housing of claim 2 including means aligning said lower and upper shafts.

4. The rotatable food serving housing of claim 1 including food cooling means in said space.

5. The rotatable food serving housing of claim 1 including means for aligning said top to said base about edges of said base and said top.

6. The rotatable food serving housing of claim 1 wherein said base, said top and said trays are of a polymer.

7. Rotatable food serving housing comprising:

a. a base including opposing semicircular compartments generally forming a circle about a first central hole, with a space generally bisecting the circle on a diameter therebetween;

b. a swivel means on an underside of said base;

c. two opposing semicircular food trays including at least one food or can area for engaging into each of said semicircular compartments; and, d. a top including two opposing hinged covers engaging with said base and a second central hole extending therethrough for aligning with the first central hole.

8. The rotatable food serving housing of claim 7 including lower and upper shafts in said base and said top about said central holes for receiving an umbrella pole.

9. The rotatable food serving housing of claim 8 including means aligning said lower and upper shafts.

10. The rotatable food serving housing of claim 7 including food cooling means in said space.

11. The rotatable food serving housing of claim 7 including means for aligning said top to said base about edges of said base and said top.

12. The rotatable food serving housing of claim 7 wherein said base, said top and said trays are of a polymer.

13. Rotatable food serving housing comprising:

a. a base including opposing semicircular compartments generally forming a circle about a first central hole, with a space generally bisecting the circle on a diameter therebetween for holding food cooling means;

b. a swivel means on an underside of said base;

c. a semicircular food tray including at least one food or can area for engaging into each of said semicircular compartments;

d. a top including two opposing hinged covers engaging with said base and a second central hole extending therethrough for aligning with the first central hole; and, e. means for engaging said top to said base.

14. The rotatable food serving housing of claim 13 including lower and upper shafts in said base and said top about said central holes for receiving an umbrella pole.

15. The rotatable food serving housing of claim 14 including means aligning said lower and upper shafts.

16. The rotatable food serving housing of claim 13 including means for aligning said top to said base about edges of said base and said top.

* * * * *